US009132929B2

(12) United States Patent
Nash

(10) Patent No.: US 9,132,929 B2
(45) Date of Patent: Sep. 15, 2015

(54) FILLING AND SEALING OF BEVERAGE CONTAINERS

(76) Inventor: James Nash, London (GB)

( * ) Notice: Subject to any disclaimer, the term of this patent is extended or adjusted under 35 U.S.C. 154(b) by 1082 days.

(21) Appl. No.: 12/760,427

(22) Filed: Apr. 14, 2010

(65) Prior Publication Data

US 2010/0263329 A1 Oct. 21, 2010

(30) Foreign Application Priority Data

Apr. 14, 2009 (GB) ..... 0906430.4

(51) Int. Cl.

| | |
|---|---|
| ***B65B 31/04*** | (2006.01) |
| ***B65B 7/28*** | (2006.01) |
| ***B65B 31/00*** | (2006.01) |
| *A47G 19/22* | (2006.01) |
| *B65D 81/20* | (2006.01) |
| *B65B 3/04* | (2006.01) |

(52) U.S. Cl.

CPC ..... *B65B 31/043* (2013.01); *B65B 7/2878* (2013.01); *B65B 31/00* (2013.01); *A47G 19/2205* (2013.01); *B65B 3/04* (2013.01); *B65D 81/2076* (2013.01)

(58) Field of Classification Search

CPC ..... B65B 31/028; B65B 31/04; B65B 31/043
USPC ..... 53/432, 434, 478, 485, 267, 272, 290, 53/371.6, 373.7, 329.2, 433, 510, 511, 53/471, 281, 282, 284.5, 284.6, 412, 53/133.1, 133.2, 133.7
See application file for complete search history.

(56) References Cited

U.S. PATENT DOCUMENTS 2,054,492 A 9/1936 Young
2,322,250 A * 6/1943 Murch ..... 53/510

(Continued)

FOREIGN PATENT DOCUMENTS

EP 1235501 9/2002
FR 2882725 A1 * 9/2006 ..... B65B 31/028

(Continued)

OTHER PUBLICATIONS

Patents Form 2, "Initiation of proceedings before the Comptroller," filed in the UK Intellectual Property Office by Andrew Russell Niel Clements of Schlich & Co. on Nov. 18, 2011 (2 pgs).

(Continued)

*Primary Examiner* — Stephen F Gerrity
(74) *Attorney, Agent, or Firm* — Hayes Soloway P.C.

(57) ABSTRACT

A beverage container is filled and sealed by:

a) dispensing a predetermined amount of beverage, preferably wine, into an open-topped container having a circular rim, preferably a plastics wine glass, to leave a headspace above the beverage in the container;

b) temporarily tacking a generally flat flexible film lid sized to fit over the open top to the rim of the container at at least one position around the rim while leaving the remainder of the rim free;

c) engaging the tacked lid to cause flexure thereof to create a gap between the lid and the rim on one side;

d) dispensing an inert gas, preferably nitrogen, through the gap so created and into the headspace to displace air therefrom; and e) bringing a heat sealer into engagement with the lid to heat seal the lid to the rim about its entire circumference, thereby trapping the inert gas within the headspace.

15 Claims, 2 Drawing Sheets

(56) References Cited

U.S. PATENT DOCUMENTS

| | | | | | |
|---|---|---|---|---|---|
| 3,085,374 | A * | 4/1963 | Powell | 53/412 |
| 3,360,382 | A * | 12/1967 | Miller | 53/432 |
| 3,908,340 | A * | 9/1975 | Erhardt | 53/329.3 |
| 4,409,252 | A | 10/1983 | Buschkens et al. | 426/396 |
| 4,809,486 | A * | 3/1989 | Chanel | 53/510 |
| 4,896,479 | A * | 1/1990 | Gannon | 53/432 |
| 5,071,667 | A | 12/1991 | Grune et al. | 426/396 |
| 5,155,971 | A * | 10/1992 | Zopf | 53/432 |
| 5,195,298 | A * | 3/1993 | Baranowski | 53/425 |
| 5,419,096 | A * | 5/1995 | Gorlich | 53/432 |
| 6,161,367 | A * | 12/2000 | Walter | 53/478 |
| 6,296,726 | B1 * | 10/2001 | Pencak | 156/64 |
| 2009/0100797 | A1 * | 4/2009 | Carvin et al. | 53/79 |
| 2013/0042578 | A1 | 2/2013 | Jackson-Ebben et al. | 53/432 |

FOREIGN PATENT DOCUMENTS

| | | | |
|---|---|---|---|
| GB | 2385577 | 8/2003 | |
| JP | 63-281930 | 11/1988 | B65B 31/06 |
| WO | WO 96/05123 | 2/1996 | |
| WO | WO 96/41743 | 12/1996 | B65B 31/06 |

OTHER PUBLICATIONS

Patents Act 1977, "Statement of Grounds," filed in the United Kingdom Intellectual Property Office on Nov. 15, 2011 (4 pgs).
Correspondence to James Nash from Andrew Bushell, Patents Directorate at the UK Intellectual Property Office, dated Nov. 30, 2011 (6 pgs).
Correspondence to Guy Jackson-Ebben from Andrew Bushell, Patents Directorate at the UK Intellectual Property Office, dated Nov. 30, 2011 (2 pgs).
Correspondence to Andrew Bushell, Patents Directorate at the UK Intellectual Property Office, from Schlich & Co., dated Dec. 12, 2011 (1 pg).
Correspondence to Andrew Bushell, Patents Directorate at the UK Intellectual Property Office, from Schlich & Co., dated Jan. 9, 2012 (10 pgs).
Correspondence to Guy Jackson-Ebben from Andrew Bushell, Patents Directorate at the UK Intellectual Property Office, dated Jan. 12, 2012 (8 pgs).
Correspondence to Guy Jackson-Ebben from Andrew Bushell, Patents Directorate at the UK Intellectual Property Office, dated Jan. 19, 2012 (8 pgs).
Correspondence to Andrew Bushell, Patents Directorate at the UK Intellectual Property Office, from Schlich & Co., dated Jan. 24, 2012 (2 pgs).
Patents Form 4, "Continuation of proceedings before the Comptroller," via Special Delivery to the United Kingdom Intellectual Property Office from Schlich & Co. on Feb. 1, 2012 (2 pgs).
Correspondence to Guy Jackson-Ebben from Andrew Bushell, Patents Directorate at the UK Intellectual Property Office, dated Feb. 3, 2012 (7 pgs).
Correspondence to Guy Jackson-Ebben from Andrew Bushell, Patents Directorate at the UK Intellectual Property Office, dated Feb. 7, 2012 (2 pgs).
Correspondence to the UK Intellectual Property Office from George W. Schlich, dated Feb. 17, 2012 (1 pg).
Correspondence to Guy Jackson-Ebben from Susan Williams, Patents Directorate at the UK Intellectual Property Office, dated Mar. 1, 2012 (1 pg).
Correspondence to Guy Jackson-Ebben from Joanne Roberts, Patents Directorate at the UK Intellectual Property Office, dated Apr. 17, 2012 (2 pgs).
Correspondence to George W. Schlich of Schlich & Co. from Michael Deans of M.J.P. Deans, dated Jun. 25, 2012 (4 pgs).
Correspondence to the UK Intellectual Property Office from Schlich LLP, dated Jun. 26, 2012 (1 pg).
Correspondence to Guy Jackson-Ebben from Joanne Roberts, Patents Directorate at the UK Intellectual Property Office, dated Oct. 3, 2012 (1 pg).
Correspondence to the UK Intellectual Property Office from Schlich LLP, filed Oct. 17, 2012 (17 pgs).
Correspondence to George W. Schlich of Schlich & Co. from Michael Deans of M.J.P. Deans, dated Nov. 6, 2012 (26 pgs).
Correspondence to the UK Intellectual Property Office from Schlich LLP, filed Nov. 7, 2012 (1 pg).
Correspondence to the UK Intellectual Property Office from Schlich LLP, filed Nov. 13, 2012 (6 pgs).
Correspondence to the UK Intellectual Property Office from M.J.P. Deans, dated Nov. 14, 2012 (2 pgs).
Correspondence to Guy Jackson-Ebben from Martyn Jefferiss, Patents Directorate at the UK Intellectual Property Office, dated Dec. 3, 2012 (2 pgs).
Correspondence to Guy Jackson-Ebben from Joanne Roberts, Patents Directorate at the UK Intellectual Property Office, dated Dec. 10, 2012 (1 pg).
Correspondence to Guy Jackson-Ebben from Joanne Roberts, Patents Directorate at the UK Intellectual Property Office, dated Jan. 23, 2013 (7 pgs).
Correspondence to Guy Jackson-Ebben from Joanne Roberts, Patents Directorate at the UK Intellectual Property Office, dated Mar. 11, 2013 (1 pg).
Correspondence to Joanne Roberts, Patents Directorate at the UK Intellectual Property Office, from Schlich LLP, dated Mar. 25, 2013 (5 pgs).
Correspondence to the UK Intellectual Property Office from M.J.P. Deans, dated Mar. 25, 2013 (2 pgs).
Correspondence to Guy Jackson-Ebben from Joanne Roberts, Patents Directorate at the UK Intellectual Property Office, dated May 8, 2013 (11 pgs).
Correspondence to Joanne Roberts, Patents Directorate at the UK Intellectual Property Office, from Schlich LLP, dated May 22, 2013 (2 pgs).
Correspondence to Guy Jackson-Ebben from Joanne Roberts, Patents Directorate at the UK Intellectual Property Office, dated May 24, 2013 (2 pgs).
Correspondence to Guy Jackson-Ebben from Joanne Roberts, Patents Directorate at the UK Intellectual Property Office, dated Jun. 18, 2013 (4 pgs).
Correspondence to Guy Jackson-Ebben from Darran Cooke, Patents Directorate at the UK Intellectual Property Office, dated Aug. 8, 2013 (2 pgs).
Correspondence to the UK Intellectual Property Office from Schlich LLP, dated Sep. 9, 2013 (7 pgs).
Correspondence to Darren Cooke from Schlich LLP, dated Sep. 10, 2013 (6 pgs).
Correspondence to the UK Intellectual Property Office from M.J.P. Deans, via fax on Sep. 10, 2013 (5 pgs).
Correspondence to Darren Cooke from Schlich LLP, dated Sep. 12, 2013 (8 pgs).
Correspondence to Guy Jackson-Ebben from Joanne Roberts, Patents Directorate at the UK Intellectual Property Office, dated Sep. 16, 2013 (2 pgs).
Correspondence to the UK Intellectual Property Office from M.J.P. Deans, dated Sep. 19, 2013 (3 pgs).
Correspondence to Joanne Roberts, Patents Directorate at the UK Intellectual Property Office, from Schlich LLP, dated Sep. 24, 2013 (2 pgs).
Correspondence to Hayes Soloway from Schlich LLP dated Sep. 26, 2013 (2 pgs).
British Combined Search and Examination Report, dated Jul. 15, 2010, for GB1005488.0, 6 pages.

* cited by examiner

FILLING AND SEALING OF BEVERAGE CONTAINERS

FIELD OF THE INVENTION

The present invention concerns filling and sealing of beverage containers.

BACKGROUND TO THE INVENTION

Wine is traditionally sold by the bottle, usually in 70 cl bottles. However, it is drunk by the glass, and often sold in bars, cafes and restaurants by the glass in measures of different sizes. The bar, cafe or restaurant owner must supply glasses, dispense the selected wine from a bottle into the glass, collect empties and wash them up for reuse. There are thus significant capital and labour costs inherent in selling wine in the traditional manner by the glass. Usually only a small selection of popular wines will be supplied in this way since, once a bottle is opened, its contents will start to oxidise. Small amounts of wine left at the end of a bottle must generally be thrown away.

Because consumers drink wine by the glass, some would like to purchase it from take-aways, sandwich bars and supermarkets pre-packaged in single glass quantities. Attempts to supply wine in small cans has not proved a success, as wine drinkers are reluctant to drink from a can, so that a disposable glass needs to be supplied as well as the can. Supplying wine pre-packaged in sealed glass-shaped plastics containers is attractive to the organizers of outdoor events, as this removes the need to open bottles or cans to dispense wine and avoids any wastage. All that is required is the provision of waste bins for used plastics glasses. For sealed glass-shaped containers of wine to prove a commercial success, the wine must have an extended shelf-life. With a view to avoiding oxidation, the first attempts to fill and seal wine in plastics glasses filled the wine to the brim to largely eliminate any headspace containing air. This proved unsuccessful, as the wine was inevitably spilled when a user tried to remove the sealed lid. Users are only prepared to buy wine in a glass when they can see a clear headspace above the wine. Attempts have been made to fill the glass in environmentally controlled conditions with an inert atmosphere such as nitrogen, but this has added significantly to filling costs. Examples of this are disclosed in EP 1235501B (Pascal) and in PCT WO9605123 (Johnston). An attempt to overcome this problem has been the adoption of dished lids sealed to the edge of the glass but extending down into the glass itself to reduce any air-filled headspace to a minimum but without the wine being filled to the brim. Such an arrangement is disclosed in GB 2,385,577B (Valentine). However, this use of preformed lids rather than simple, generally flat, flexible film lids both adds to expense and still does not result in a filled product with an extended shelf life that has the clear headspace that customers desire.

The methods disclosed herein-below have arisen from our work seeking to overcome these problems and to provide in an economically efficient manner an aesthetically and commercially attractive filled and sealed beverage container, preferably though not necessarily exclusively, sealed plastics glasses of wine.

SUMMARY OF THE INVENTION

In accordance with a first aspect of this disclosure, there is provided a method of filling and sealing a beverage container, the method comprising the steps of:

a) dispensing a predetermined amount of beverage into an open-topped container having a circular rim to leave a headspace above the beverage in the container;
b) temporarily tacking a generally flat flexible film lid sized to fit over the open top to the rim of the container at at least one position around the rim while leaving the remainder of the rim free;
c) engaging the tacked lid to cause flexure thereof to create a gap between the lid and the rim on one side;
d) dispensing an inert gas or substantially oxygen free gas or gases through the gap so created and into the headspace to displace air therefrom; and
e) bringing a heat sealer into engagement with the lid to heat seal the lid to the rim about its entire circumference, thereby trapping the inert gas or substantially oxygen free gas or gases within the headspace.

The tacked lid may be engaged in a number of different ways to cause flexure thereof to create the gap. For example, a sucker arm may lift an edge of the lid vertically, or a horizontally acting pusher arm may push an edge portion of the lid. However, in the particularly preferred arrangement, the lid is generally circular with an area corresponding to the area of the container at its rim and having a tab extending beyond the said rim to one side of the container for subsequent manual removal of the lid by a consumer to open the sealed container in order to drink the beverage, and the tab is pushed to cause flexure of the lid.

Accordingly, in a second and alternative aspect of this disclosure, there is provided a method of filling and sealing a beverage container, the method comprising the steps of: dispensing a predetermined amount of beverage, preferably wine, into an open-topped container having a circular rim, preferably a plastics wine glass, to leave a headspace above the beverage in the container; temporarily tacking a generally flat flexible film lid sized to fit over the open top to the rim of the container at at least one position around the rim while leaving the remainder of the rim free, the lid being generally circular with an area corresponding to the area of the container at its rim and having a tab extending beyond the said rim to one side of the container for subsequent manual removal of the lid by a consumer to open the sealed container in order to drink the beverage; pushing the tab to cause flexure of the lid to create a gap between the lid and the rim on one side; dispensing an inert gas, preferably nitrogen through the gap so created and into the headspace to displace air therefrom; and bringing a heat sealer into engagement with the lid to heat seal the lid to the rim about its entire circumference, thereby trapping the inert gas within the headspace.

Preferred embodiments have one or more of the following features: The gap is created by using relative movement between the container and a ring of radius slightly larger than the radius of the container at its rim to cause the ring to engage the tab. The ring takes the form of a skirt. The inert gas is supplied via the skirt, which serves to partially contain the inert gas. A flush of inert gas is timed to coincide with the skirt brushing the tab. The heat sealer is generally annular and mounted coaxially with the skirt for relative movement between heat sealer and container to bring the heat sealer into engagement with the lid while the container is within the ring.

Preferably the vessel is a wineglass into which wine is dispensed in the method. A particularly preferred form of the glass is where the glass comprises a goblet moulded from PET (Polyethylene terephthalate). The lid is preferably dispensed from a stack of lids in a hopper or cassette by a suction arm. The suction arm is preferably adapted to swivel from a position in which ft engages the lowermost lid of the stack to a position in which it places the lid atop the rim of the container. The suction arm preferably includes a spot heat sealer to provide the temporary tacking. The method is preferably performed on an indexed turntable, with successive index positions for (i) filling, (ii) initial application of a lid, (iii) flexure and inert gas flush and final seal and (iv) presenting the filled and sealed container to a packaging conveyor.

In a third aspect of this disclosure, there is provided a system for filling and sealing a beverage container, the system comprising:

a) a dispenser for dispensing a predetermined amount of beverage into an open-topped container having a circular rim to leave a headspace above the beverage in the container;

b) a device for temporarily tacking a generally flat flexible film lid sized to fit over the open top to the rim of the container at at least one position around the rim while leaving the remainder of the rim free;

c) a device for engaging the tacked lid to cause flexure thereof to create a gap between the lid and the rim on one side;

d) a dispenser for dispensing an inert gas or substantially oxygen free gas or gases through the gap so created and into the headspace to displace air therefrom; and e) a heat sealer configured to be brought into engagement with the lid to heat seal the lid to the rim about its entire circumference, thereby trapping the inert gas or substantially oxygen free gas or gases within the headspace.

BRIEF DESCRIPTION OF THE DRAWINGS

Examples of methods and apparatus in accordance with our teaching are described below by way of example only with reference to the accompanying drawings, in which.

DESCRIPTION OF THE PREFERRED EMBODIMENT

Figure 1:
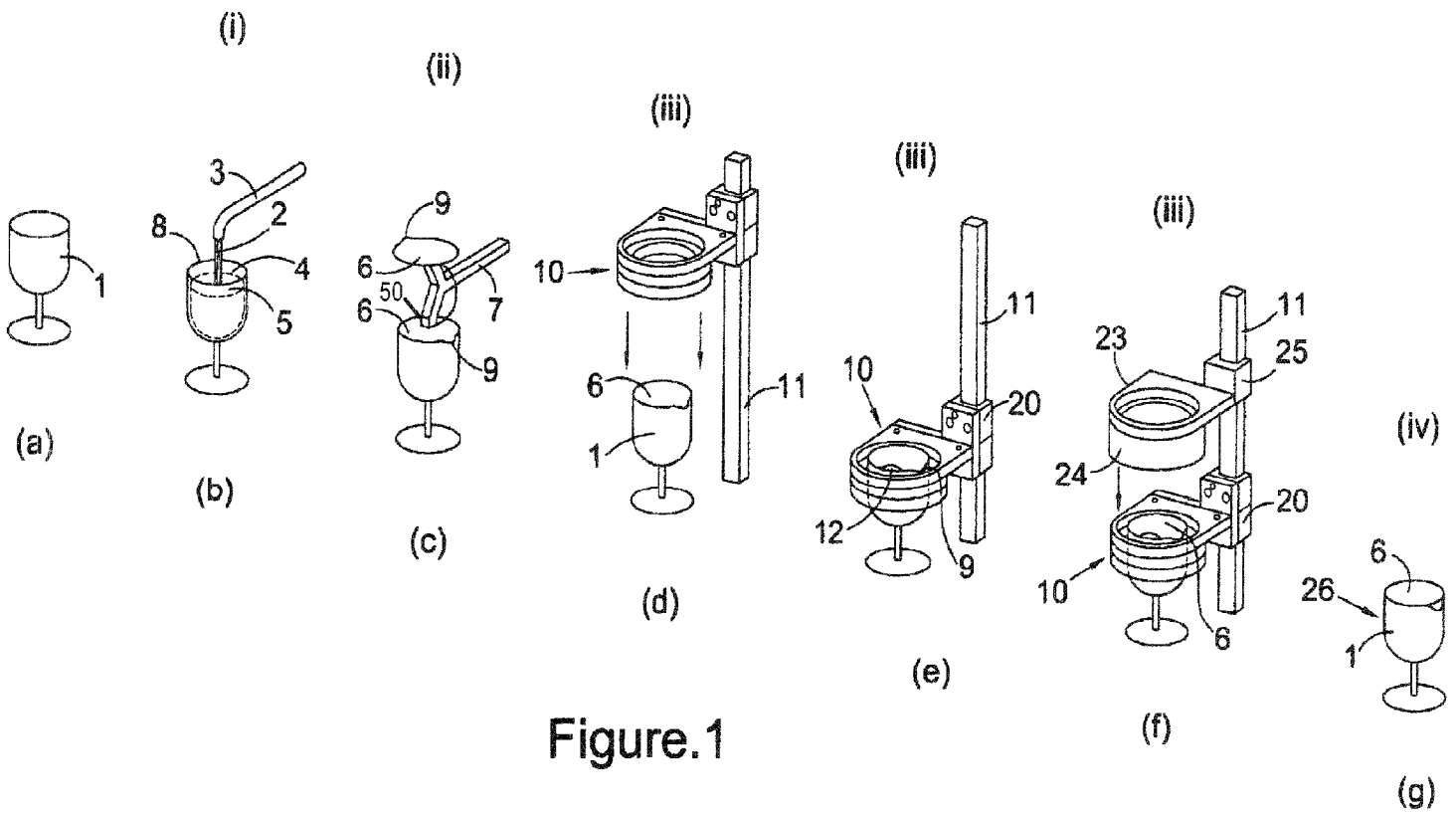
FIG. 1 schematically illustrates successive stages (a) to (g) in the filling and sealing of a glass.

A beverage container, here a clear goblet 1 formed of PET, is supplied in Step (a) to a turntable (not shown). The turntable presents the glass 1 to a plurality of indexed stations as it rotates. At the first index position (i) a predetermined volume of a beverage, here wine 2, is dispensed via fill nozzle 3 into the open top 4 of glass 1 in Step (b).

This disclosure is not concerned with details of the beverage supply, measured dispensing or filling systems. Any suitable such systems may be employed and persons engaged in the beverage industry will have wide knowledge of such systems. Other beverage containers other than a clear plastics goblet may equally well be employed.

A clear headspace 5 is left between the level of wine 2 and open top 4 of glass 1. The filled glass is carried by the turntable to the second index position (ii), where a generally flat flexible film lid 6 is applied to the open top 4 of glass 1 in step (c). In the illustrated arrangement, a swivel suction arm 7 withdraws lowermost lid 6 from a stack of lids in a hopper or cassette (not shown), and is swiveled, as shown by the arrow, to place lid 6 atop glass 1. The swivel section of arm 7 includes a spot heat sealer 50 which spot tracks the lid 6 to rim 8 of the glass 1 at one or more points to hold the lid temporarily in place, while leaving the remainder of the lid free around the circumference of the rim 8.

This disclosure is not concerned with details of the hopper or feeding mechanism for individual lids or with details of the swivel arm or spot heat sealer. All that is required is that a lid sized to fit over the open top of the container be placed in position and temporarily tacked at at least one position on the rim while leaving the remainder of the lid free. Persons familiar with fill and seal systems will readily be able to adapt existing mechanisms to achieve these steps. Any suitable such mechanism may be employed.

The lid 6 consists of a generally flat flexible film and, in this arrangement, is circular with an area corresponding to that of glass 1 at its rim 8, and having a tab 9 extending beyond the rim 8 to one side of the container to allow a consumer to grasp the tab to manually remove lid 6 from glass 1 in order to drink the wine 2. The film lid may be made of a variety of materials, suitably biocompatible materials with good oxygen barrier properties as desired and may comprise several layers, the lowermost of which is a heat seal layer that will fuse with the PET of the glass to form a seal sufficient to hold the lid firmly in position but capable of being broken by pulling on tab 9.

Persons familiar with the packaging of foodstuffs will readily be able to source suitable lids without further instruction. Examples of suitable materials are given in the previously referenced prior art but any suitable such flexible film lid with the appropriate geometry may be employed. The temporarily lidded glass is carried by the turntable to the third index position (iii). Here, as explained below, relative movement takes place between the temporarily lidded glass 1 and a ring 10 in Step (d), the ring 10 being moved generally vertically down a rail 11 in the illustrated arrangement, while the glass 1 is held stationary; and the ring 10 engages tab 9 to push it down sufficiently to cause upward flexure of the lid to create a gap 12 between lid and rim into which an inert gas is dispensed in Step (e).

Figure 2:
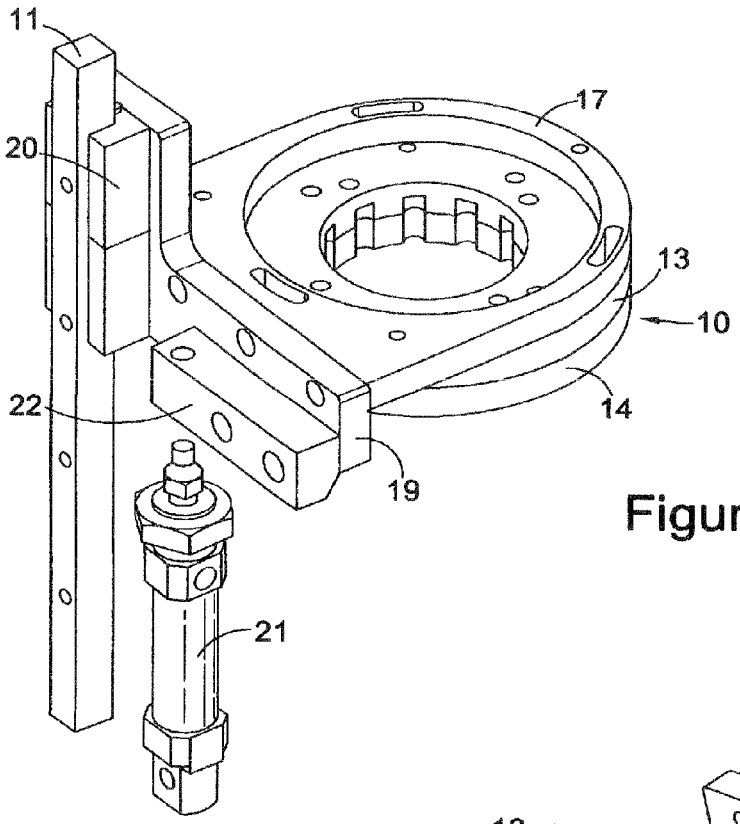
FIG. 2 shows a perspective view of a gas flushing ring assembly.
Figure 3:
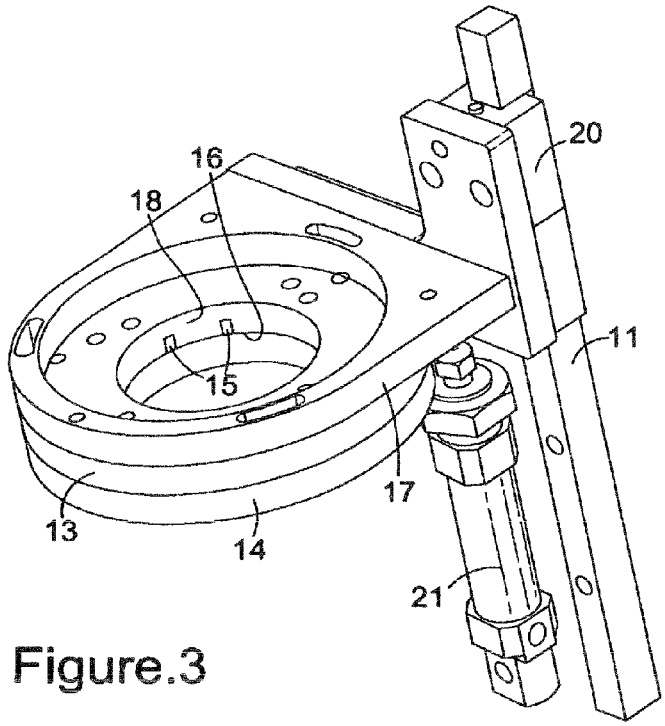
FIG. 3 shows a perspective view of the assembly of FIG. 2 from the opposite side.

Reference should be made to FIGS. 2 and 3 for details of a preferred ring assembly. The ring 10, itself, is formed in two halves 13 and 14. The upper half 13 forms an upper gas flush plate, while lower half 14 forms a lower gas flush plate, the two effectively forming a skirt that surrounds the top of glass 1, as shown at (e) in FIG. 1, to partially contain dispensed inert gas, as explained below.

One or more, here a plurality, of gas flush channels 15 are defined between the upper and lower gas flush plates, in this case by machining the channels in lower face 16 of the upper plate. The ring assembly of gas flush plates 13, 14 is mounted on an adjustment plate 17 that allows some adjustment in the position of the gas flush nozzles, as defined by the openings of channels 15 on inner surface 18 of upper gas flush plate 13, angularly about the axis of the ring assembly. An adapter plate 19 serves both to couple the adjuster plate 17 to a carriage 20 adapted to move vertically on linear rail 11, and to mount a cylinder 21 of inert gas, preferably nitrogen, shown separated in FIG. 2, via a cylinder mount plate 22.

The coupling between the carriage 20 and rail 11 has been omitted from the drawings for economy of drawing. The details of such coupling and of the drive for achieving the required indexed movement of the carriage 20 with the ring assembly 10 on rail 11 are not of importance to the present disclosure. Persons familiar with automated machinery will readily be able to provide for such coupling, and for the drive to achieve the required indexed movement, without further instruction. Any suitable such coupling and any suitable such drive may be employed.

Referring again to FIG. 1, as the ring assembly 3, the inner radius of which is only slightly larger than the radius of the glass 1 at its rim 8, is lowered over the top of the glass, the ring assembly 10 brushes against tab 9, and, in so doing, pushes it down sufficiently to cause upward flexure of the flexible film lid 6 to create gap 12 between the lid and the rim 8. As ring assembly 10 engages tab 9 to create gap 12, a flush of inert gas is timed to be dispensed from channels 15 through gap 12 and into the headspace 5 within the temporarily lidded glass defined between wine 2 and lid 6, to displace air from the headspace, thereby completing Step (e).

At the same time, Step (f) is initiated to bring a heat sealer 23 into engagement with the lid 6 to heat seal the lid to the rim about its entire circumference, thereby trapping the inert gas within the headspace. In the illustrated arrangement, heat sealer 23 comprises a machined annular copper heat seal plate 24 mounted from a carriage 25 adapted to move vertically along rail 11, the heat seal plate 24 being adapted to come down within the inner radius of the gas flush plates to engage the lid 6 immediately over rim 8 of glass 1 to effect a seal around the entire circumference of the rim.

The filled and sealed wine glass 26 is then moved by the turntable to its final index position (iv) in Step (g), where it is presented to a packaging conveyor of conventional form (not illustrated) for movement to a packaging station for packaging and dispatch to customers.

While the system described above is particularly suitable for filling and sealing wine in plastics goblets with a lid having a tab for pulling the lid free, other arrangements are feasible. Thus the lid need not be circular and need not have a tab. The term "circumference" is used herein to refer to 'the whole of the rim", even in the case of a container with a non-circular opening. Thus, the lid may be generally square and arranged to be pierced by a drinking straw to reach a soft drink packaged within an opaque four sided plastics container, so that it has no tab. The lid need not extend beyond the edge of the rim of the container. In such arrangement, a ring assembly 3 could not be employed to cause flexure of the lid. Instead, a vertically acting sucker arm may be used to lift the tacked lid slightly to create a gap for the inert gas.

Other arrangements for causing flexure of the tacked lid are also feasible. Thus a horizontally reciprocating side arm may push an edge portion of the tacked lid opposite the tacked portion and slightly towards it sufficiently to flex the lid and create a gap.

It will also be appreciated that beverages other than wine may be filled, sealed and packaged in accordance with the teachings herein. Thus beer may be packaged in a PET beer glass in a similar manner to the packaging of wine as specifically described above.

The invention claimed is:

1. A method of filling and sealing a beverage container of the kind from which a user may drink, the method comprising the following steps in order:

a) dispensing a predetermined amount of beverage into an open-topped container having a rim to leave a headspace above the beverage in the container;

b) placing a flexible film lid flat on top of the container touching the entire rim of the container, the film lid having a tab extending beyond the rim of the container;

c) temporarily tacking the film lid to the rim of the container at at least one position around the rim while leaving the remainder of the rim free;

d) engaging the tab of the tacked lid by relative vertical movement between the container and a ring an inner boundary of which defines an area slightly larger than an area defined by an external boundary of the container at its rim to cause flexure of the lid from its flat state to create a gap between the lid and the rim;

e) dispensing an inert gas or substantially oxygen free gas or gases through the gap so created and into the headspace to displace air therefrom; and f) bringing a heat sealer into engagement with the lid to heat seal the lid to the rim about its entire circumference, thereby trapping the inert gas or substantially oxygen free gas or gases within the headspace;

wherein the sealed lid is adapted for subsequent manual removal using the tab to open the sealed container to allow a user to drink from the container.

2. The method of claim 1, wherein the ring takes the form of a skirt and the inert gas is supplied via the skirt, which serves to partially contain the inert gas or substantially oxygen free gas or gases.

3. The method of claim 2, wherein a flush of inert gas or substantially oxygen free gas or gases is timed to coincide with the skirt engaging the tab.

4. The method of claim 2, wherein the heat sealer is generally annular and mounted coaxially with the skirt for relative movement between the heat sealer and container to bring the heat sealer into engagement with the lid while the container is within the ring.

5. The method of claim 1, wherein the container comprises a goblet formed of polyethylene terephthalate.

6. The method of claim 1, wherein the lid is dispensed from a stack of lids in a hopper or cassette by a suction arm.

7. The method of claim 6, wherein the lid dispensing suction arm swivels from a position in which the arm engages a lowermost lid of the stack to a position in which the arm places the lid atop the rim of the container.

8. The method of claim 6, wherein the suction arm includes a spot heat sealer, and the spot heat sealer provides the temporary tacking.

9. The method of claim 1, wherein the method is performed on an indexed turntable, with successive index positions for (i) filling, (ii) initial application of a lid, (iii) flexure and inert gas flush and final seal and (iv) presenting the filled and sealed container to a packaging conveyor.

10. A system for filling and sealing a beverage container of the kind from which a user may drink, the system comprising:

a) a dispenser adapted to dispense a predetermined amount of beverage from a supply thereof into an open-topped container having a rim to leave a headspace above the beverage in the container;

b) a device arranged to place a flexible film lid flat on top of the container touching the entire rim of the container, the film lid having a tab extending beyond the rim of the container;

c) a tacking device adapted to tack the film lid to the rim of the container at at least one position around the rim while leaving the remainder of the rim free;

d) a ring an inner boundary of which defines an area slightly larger than an area defined by an external boundary of the container at its rim, and means for causing vertical movement of the ring relative to the container to cause engagement of the ring with the tab of the tacked lid to cause flexure of the lid from its flat state to create a gap between the lid and the rim;

e) a dispenser adapted to dispense an inert gas or substantially oxygen free gas or gases from a supply thereof through the gap so created and into the headspace to displace air therefrom; and f) a heat sealer configured to be brought into engagement with the lid to heat seal the lid to the rim about its entire circumference, thereby trapping the inert gas or substantially oxygen free gas or gases within the headspace.

11. The system of claim 10, wherein the ring takes the form of a skirt coupled to supply the inert gas via the skirt, which serves in use to partially contain the inert gas or substantially oxygen free gas or gases.

12. The system of claim 11, wherein the heat sealer is generally annular and mounted coaxially with the skirt for relative movement between the heat sealer and container to bring the heat sealer into engagement with the lid while the container is within the ring.

13. The system of claim 10, wherein the device arranged to place a flexible film lid flat on top of the container touching the entire rim of the container is adapted to dispense the lid from a stack of lids in a hopper or cassette using a suction arm.

14. The system of claim 13, wherein said lid dispensing suction arm is adapted to swivel from a position in which the arm engages a lowermost lid of the stack to a position in which the arm may place the lid atop the rim of the container.

15. The system of claim 13, wherein the suction arm includes a spot heat sealer and the spot heat sealer provides said tacking device.

* * * * *